US006557216B1

(12) United States Patent
Andre et al.

(10) Patent No.: US 6,557,216 B1
(45) Date of Patent: May 6, 2003

(54) CRIMPING RING, METHOD FOR MAKING SAME AND MANUFACTURING INSTALLATION

(75) Inventors: Michel Andre, Lanthenay (FR); Pascal Detable, Gievres (FR); Gino Leze, Lanthenay (FR)

(73) Assignee: Etablissements Caillau, Issy-les-Moulineaux (FR)

( * ) Notice: Subject to any disclaimer, the term of this patent is extended or adjusted under 35 U.S.C. 154(b) by 0 days.

(21) Appl. No.: 09/914,072

(22) PCT Filed: Feb. 25, 2000

(86) PCT No.: PCT/FR00/00469

§ 371 (c)(1),
(2), (4) Date: Aug. 23, 2001

(87) PCT Pub. No.: WO00/50182

PCT Pub. Date: Aug. 31, 2000

(30) Foreign Application Priority Data

Feb. 26, 1999 (FR) ..... 99 02476

(51) Int. Cl.[7] ..... B21D 53/16; B65D 63/02; F16B 17/00; F16L 33/00

(52) U.S. Cl. ..... 24/20 CW; 24/20 R; 24/20 EE; 24/23 EE; 24/25

(58) Field of Search ..... 24/20 CW, 20 EE, 24/20 W, 20 R, 21, 23 W, 23 EE, 25

(56) References Cited

U.S. PATENT DOCUMENTS 789,193 A * 5/1905 Wickham ..... 24/20 R
1,812,151 A 6/1931 Jacocks
3,510,624 A 5/1970 Bennett
5,150,503 A * 9/1992 Muller ..... 24/20 EE
5,185,908 A * 2/1993 Oetiker ..... 24/20 R
5,469,604 A * 11/1995 Calmettes et al. ..... 24/20 CW
5,740,589 A * 4/1998 Dominguez ..... 24/20 CW
5,768,752 A * 6/1998 Oetiker ..... 24/20 R
6,421,886 B1 * 7/2002 Oetiker ..... 24/20 EE

FOREIGN PATENT DOCUMENTS

| | | |
|---|---|---|
| DE | 951 843 | 11/1956 |
| DE | 1 297 206 | 6/1969 |
| EP | 0 610 108 | 8/1994 |
| GB | 1 202 926 | 8/1970 |

* cited by examiner

*Primary Examiner*—Victor Sakran
(74) *Attorney, Agent, or Firm*—Nath & Associates PLLC; Gary M. Nath; Marvin C. Berkowitz

(57) ABSTRACT

To connect a connection element (12) to one end (10A, 10B) of the strip (10) from which the swaging ring is made, the connection element is placed against said end in such a manner that at least one anchor edge (14) of the connection element (12) is in register with said end, and pressure is exerted on the connection element (12) so as to displace the material of said end (10A, 10B) of the strip that lies beneath the connection element (12) while forming a fixing member (15) in said end that is suitable for co-operating with said anchor edge so as to hold together the connection element and said end of the strip.

30 Claims, 5 Drawing Sheets

CRIMPING RING, METHOD FOR MAKING SAME AND MANUFACTURING INSTALLATION

This Application is a 371, of PCT/FR00/00469, filed on Feb. 25, 2000; and French Application Serial Number 99/02476, filed on Feb. 26, 1999.

The present invention relates to a method of manufacturing a swaging ring which comprises a metal strip rolled into a hoop with its ends connected together by a connection element having at least one anchor edge.

Document EP-0 610 108 discloses a swaging ring made from a metal strip whose ends are of a thickness close to half the thickness of the strip and presenting, for example, fixing studs. To connect those ends together, a fixing plate, e.g. having holes, is put into place in such a manner that a stud is engaged in each hole. Thereafter, the free ends of the studs are riveted to the plate.

That method of manufacture and the ring it provides generally give satisfaction. Nevertheless, the method requires a first step which consists in reducing the thickness of the ends of the strip by half while simultaneously-forming fixing studs. The zones of reduced thickness and their studs then need to be dimensioned accurately so as to enable the fixing plate to be put and held in place, and the plate also needs to be made with great accuracy. Furthermore, a small amount of clearance is necessary between the plate and the strip and between the two ends of the strip in order to compensate for tolerances when positioning the studs in the holes of the plate. This clearance runs the risk of weakening the final connection.

In short, in that method, it is necessary to form the studs at the ends of the strip, to shape the plate, to put the plate into position while engaging the studs in the holes therein, to rivet the studs, and also to perform finishing operations (removing excess material, . . . ). That succession of operations turns out to be relatively lengthy and expensive.

The invention seeks to improve the above-mentioned method so as to overcome the drawbacks mentioned above.

This object is achieved by the fact that to connect said connection element to one end of the strip the connection element is placed against said end in such a manner that said anchor edge of the connection element is in register with said end, and pressure is exerted on the connection element in such a manner as to upset the material of said end of the strip lying beneath the connection element while providing a fixing member in said end suitable for co-operating with said anchor edge to hold the connection element and said end of the strip relative to each other in such a manner that the thickness of the ring in the region of the connection element is substantially equal to the thickness of strip.

As explained below, depending on which implementation is under consideration, the anchor edge(s) can be constituted by the edges of a hole formed in the connection element, or by an appropriate shape (indentations, angular cutouts, . . . ) in the outline or in one of the faces of the connection element.

The connection element is thus connected to the ends of the strip by a simple mechanical action of applying pressure which displaces the material situated beneath the connection element (cutting it or upsetting it). The connection element is integrated in the thickness of the strip, with the connection giving rise to no significant increase in thickness and the ring obtained in this way is cylindrical in shape, with inside and outside cylindrical surfaces that are smooth.

Once the connection element has been placed against the end of the strip, pressure is exerted on all or substantially all of the surface of the connection element which covers said end, thereby making it possible to integrate the connection element in the thickness of said end.

Once the connection element has been properly shaped with its anchor edge(s), it then suffices to perform a step of applying pressure so as to put said element into place and so as to provide connection by forming the fixing member(s) without there being any need to pre-form said fixing members. The connection element serves as a shaping tool and it remains in place in the ring to provide connection.

The connection element can be constituted by a connection piece that is separate from the strip, this piece having at least two anchor edges. Using such a piece, at least one fixing member is formed in each of the two ends of the strip, said fixing members being suitable for co-operating respectively with each of said anchor edges so as to unite the connection piece to both ends of the strip.

The overall shape of the connection piece can be that of a plate. It can also be of a different shape, possessing portions in relief, as explained below.

Thus, in the method of the invention, the connection piece is used directly as a tool for shaping the ends of the strip and is embedded in the two ends of the strip, and thus in the ring which it serves to connect together. Shaping is thus simplified and is obtained directly while the piece is being put into place. Furthermore, the connection between the piece and the ends of the strip is clearly achieved without clearance. As a result, any manufacturing tolerances concerning the piece or any inaccuracy in positioning it on the strip prior to applying pressure have no effect on the quality of the connection that is finally obtained.

In some cases, the connection element can also be made in a first end of the strip during a shaping step, and then in order to unite the two ends of the strip, the shaped first end is superposed on the second end of the strip and said pressure is exerted.

In this case, it is the first end of the strip which directly constitutes the connection element and which serves as the tool for shaping the second end of the strip in which it is embedded. The connection is finally obtained without any additional piece and without clearance.

In a first implementation, the connection element is used as a tool which serves both to flatten the end of the strip on which it is placed until the thickness of the ring in the region of the connection element is substantially equal to the thickness of the remainder of the strip, and to cause the material of said end to be upset, thereby leading to the formation of at least one fixing member against the anchor edge of the connection element. The connection element is embedded in the strip and remains embedded in the ring.

This upsetting of the material gives rise to total contact between the anchor edges of the connection element and the fixing members formed by the upsetting. For example, the connection element can have holes, in which case the fixing members are formed by studs or the like which are upset into the holes of the connection element.

As mentioned above, the connection element can be a piece that is separate from the strip. Under such circumstances, even if the end edges of the strip do not touch exactly when the piece is placed against the strip, e.g. because of cutting tolerances, the operation of applying pressure gives rise to strip material being upset, thereby serving not only to form fixing members, but also to fill any gap that may exist between said end edges.

In a second implementation, the connection element is used as a cutting tool. Under such circumstances, pressure is exerted on the connection element in such a manner that the material displaced by said connection element is cut away from the strip until the element occupies the volume previously occupied by the displaced and cut-away material, and the displaced and cut-away material is removed. In this case also, the connection element is embedded in the ends of the strip which it nevertheless cuts through over the entire thickness thereof.

Thus, even if manufacturing tolerances affect the dimensions of the connection element, clearance between the connection element and the strip is eliminated since cutting always matches the dimensions of the connection element.

Preferably, in this second implementation, a connection element is used which is constituted by a solid connection piece (generally having the shape of a plate) that is separate from the strip, and whose outline defines the anchor and cutting edges.

The invention also provides a swaging ring comprising a metal strip whose ends are connected together by a connection element having at least one anchor edge.

The invention seeks to improve the swaging ring known from document EP-0 610 108, as mentioned above.

This object is achieved by the facts that: the connection element is connected to one end of the strip by a fixing member formed against the anchor edge by said connection element being put into place; the connection between the strip and the connection element has no clearance; and the thickness of the ring in the region of the connection element is substantially equal to the thickness of the strip.

In the swaging ring of the invention, the fixing member (s) is/are formed directly by upsetting the material against the anchor edge(s) of the connection element or by a portion of the strip remaining against the anchor edge after the strip has been cut by the connection element, which element remains in place in the cutout. The quality of the connection between the connection element and the strip is reinforced by the absence of clearance, such that the ring is very strong and the connection between its ends is better at withstanding the swaging operation which occurs when the ring is put into place on the object to be swaged. The connection element is embedded in the strip.

In an advantageous embodiment, the connection element is constituted by a piece that is separate from the strip, in which case the anchor edge(s) can be formed by the edges of at least one hole in the piece or by some appropriate shape (indentation, angular cutout, . . . ) in the surface of said piece, i.e. in at least one of its faces and/or in its perimeter.

In another advantageous embodiment, the connection element is constituted by a first end of the strip having at least one anchor edge. Advantageously, the anchor edge is formed by a hole, and the first and second ends of the strip are flattened against each other, a stud belonging to the second end then being formed in said hole.

The invention also provides an installation for manufacturing a swaging ring comprising means for moving together the ends of a metal strip and for connecting the ends of said strip together by a connection element having at least one anchor edge.

The invention seeks to provide an installation that is simple, capable of production at high rates of throughput so as to enable swaging rings to be manufactured reliably and with practically no clearance in the region of the connections between their ends.

This object is achieved by the fact that the installation of the invention further comprises means for placing the connection element against one end of the strip so that at least one anchor edge of said connection element is in register with said end, and a press tool for exerting pressure on the connection element in such a manner as to upset the material of said end of the strip that lies beneath the connection element while providing in said end a fixing member suitable for co-operating with said anchor edge in order to hold together the connection element and said end of the strip in such a manner that the thickness of the ring in the vicinity of the connection element is substantially equal to the thickness of the strip.

By way of example, means for placing the end edges of the strip so that they face each other can be fitted to a rolling station in which the strip is progressively rolled up until its end edges come tip to tip or practically tip to tip. Under such circumstances, the connection element can be constituted by a connection piece fed from a magazine, which can be put into place against the strip by means for handling, setting, and positioning the piece. By way of example the press tool operates like a punch driven back and forth between a rest position in which it allows a strip and a connection piece to be put into position in register with said tool, and a working position in which it performs the operation of applying pressure on the connection piece. At the same time, the strip can be held in a setting counter-tool.

The connection element can be constituted directly by a first end of the strip, in which case the installation advantageously includes means for shaping said end into a connection element with at least one anchor edge (hole, . . . ), and the rolling-up station places one of the two ends of the strip against the other.

The invention will be well understood and its advantages will appear more clearly on reading the following detailed description of embodiments given as non-limiting examples. The description refers to the accompanying drawings, in which:

FIG. 1 shows a metal strip 10, e.g. made of steel or aluminum, of the type suitable for making a swaging ring. The strip can be cut, for example, from sheet metal and it is of substantially constant thickness over its entire length.

Figure 1:
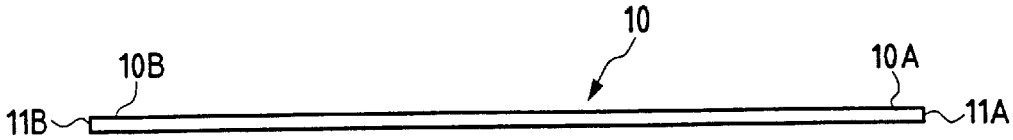
FIG. 1 is a side view of a strip from which a swaging ring of the invention can be made.
Figure 2:
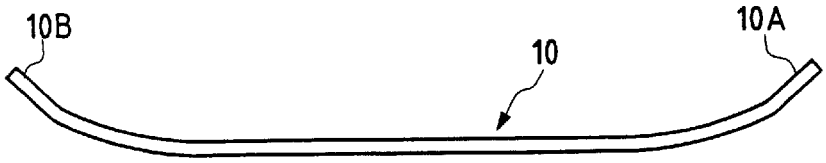
FIG. 2 shows the FIG. 1 strip while it is being rolled up.

In order to manufacture a swaging ring from such a strip, its two ends 10A and 10B are brought towards each other. This is performed, for example, during a rolling operation which can be performed in several successive stages, with FIG. 2 showing the first stage.

Figure 3A:
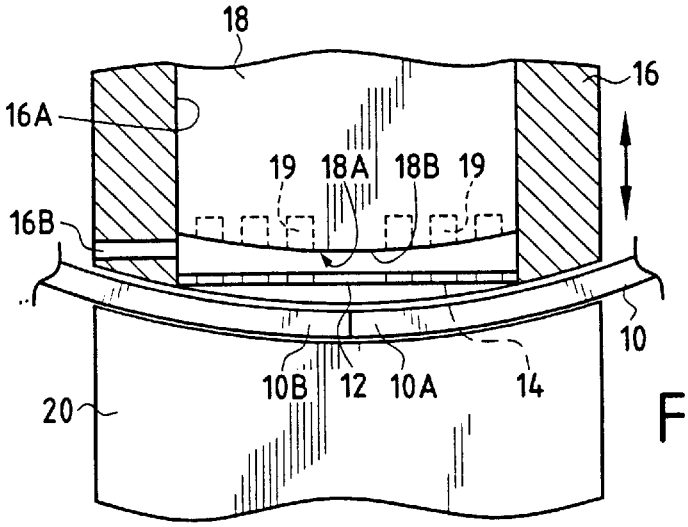
FIG. 3A shows the ends of said strip being joined together by a connection piece, in a first variant.

At the end of this operation, the strip can be rolled completely into a hoop such that its end edges 11A and 11B (free edges of the ends 10A and 10B) are placed tip to tip or substantially tip to tip. FIG. 3A shows this situation.

In this figure, there can also be seen a connection element in the form of a piece 12 that is separate from the strip 10 and that is moved into the vicinity of the ends 10A and 10B. As will be understood better from FIG. 5, this piece has a plurality of holes. Specifically, it has two series of three holes 14 disposed on either side of a transverse line of symmetry M.

The piece 12 is placed against the strip so that at least one hole 14 lies over the first end 10A of the strip and at least one other hole lies over the second end 10B of the strip. For example, the line of symmetry M of the connection piece is caused to correspond substantially to the join line between the free edges 11A and 11B. The connection piece can be placed against the strip upstream from the station in which the pressing step is performed, or in said station. It is held temporarily in place against the strip by temporary holding means. These can be claws or the like, mounted on springs and capable of retracting or of being masked in the thickness of the press tool while the pressing step is being performed.

Figure 3B:
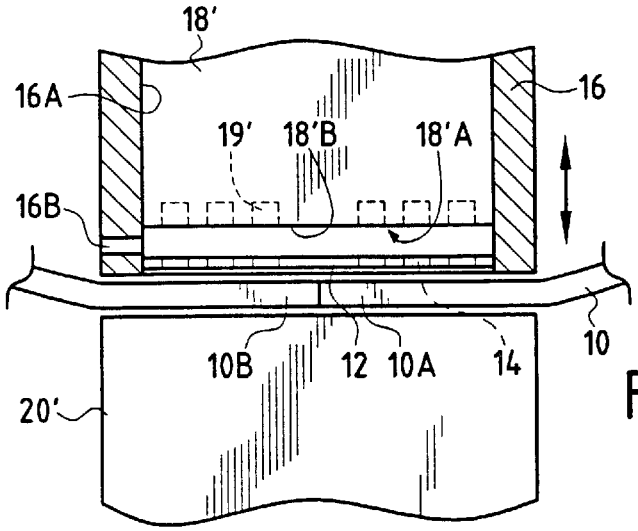
FIG. 3B is a view analogous to FIG. 3A, showing a second variant.

Nevertheless, in FIGS. 3A and 3B, these holding means are constituted by a blank press 16 that press the region of the ends of the ring against the backing tool 20. This blank press has a sleeve 16A in which the press tool 18 slides with practically no clearance, the sleeve having a section that corresponds to that of the tool of the press and to the outline of the connection piece such that said piece is held by the wall of the sleeve. To enable the piece 12 to be put into place within the sleeve 16A while the press tool 18 is in its inactive position, the blank press 16 has an opening (e.g. a slot 16B) which is clear in said inactive position. Provision could also be made for said connection piece to be put into place when the blank press is spaced apart from the strip.

It is also possible to design the manufacturing installation so that it has means for placing the connection element, e.g. the connection piece 12 on the press tool, and for said tool to be suitable for carrying said connection element so as to place it against the strip, while performing the pressing operation on a continuous basis. Thus, the connection piece 12 can be carried by the active face 18A of the press tool 18 which is provided for this purpose with temporary holding or setting means. For example, the connection piece can be held by electromagnet type means.

To perform the pressing step, the strip, or at least the vicinity of its ends 10A and 10B, is held in set manner between the backing tool 20 and the blank press 16. The press tool can move between an inactive position as shown in FIGS. 3A and 3B where it allows the strip to be put into place in the press station of the installation, and an active position in which it performs the pressing step.

In the example shown in FIG. 3A, the strip is shaped in such a manner that it presents given curvature in the vicinity of its ends 10A and 10B even before the connection piece is put into place. For example, this curvature can correspond to the curvature which the completed swaging ring is to have. The active face 18A of the press tool 18 also presents curvature substantially equal to said given curvature, thereby enabling the connection piece to be shaped properly. In addition, although FIG. 3A shows the connection piece 12 in a substantially plane configuration, this piece may be shaped prior to being put into place on the strip so that it likewise presents substantially the same curvature as the strip in the region of its ends 10A and 10B.

In the variant of FIG. 3B, the ends 10A and 10B are brought together in such a manner as to be substantially touching, however the strip has not been rolled in the vicinity of its ends, so these ends consequently remain substantially plane. The piece 12 is likewise plane, as is the active face 18'A of the press In FIGS. 3A and 3B, it can be seen that the active face 18A or 18'A of the press tool has respective indentations 19 and 19' which, during the pressing operation, are disposed to correspond with the holes 14 in the connection piece 12. Such indentations can also be seen in the active face 28A of the press tool 28 of FIG. 6 which has two series of three indentations 29 corresponding to respective holes 14 in the piece 12.

Apart from these indentations 19, 19', and 29, the active face of the press tool has solid portions 18B, 18'B, 28B disposed to correspond with the solid portions of the piece.

Figure 4:
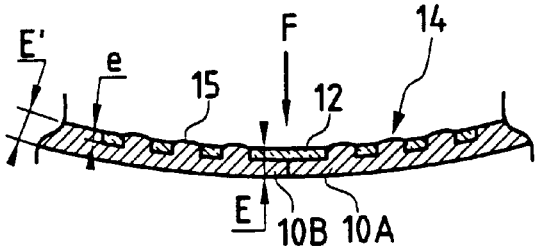
FIG. 4 shows the ring of the preceding figures in the vicinity of the ends of the strip.
Figure 7:
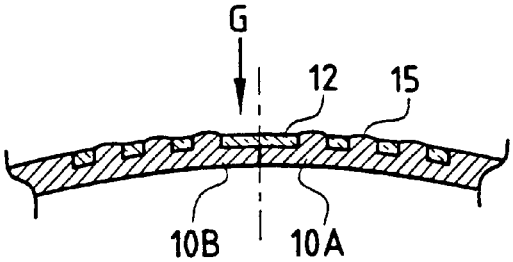
FIG. 7 is a fragmentary view of the FIG. 5 ring in section on line VII—VII.

FIGS. 4 and 7 show two variants of the completed ring in the vicinity of its connected-together ends. In FIG. 4, the connection piece 12 is placed on the inside of the ring. It can be seen that this piece is practically embedded in the thickness of the receptacle ring, the thickness E of the ring in the vicinity of the connection piece being substantially equal to its thickness E' everywhere else. This "ordinary" thickness corresponds to the thickness of the strip 10 from which the ring is made; it is the thickness of the ring prior to swaging (with the possible exception of the vicinity of the studs 15).

To retain some of the material of the strip beneath the connection piece, the thickness e of the connection piece is less than the thickness E', e.g. it is about half said thickness E'.

It will be understood from FIG. 4 that the connection piece is pressed against the ends 10A and 10B of the strip in such a manner that these ends are flattened until the thickness E (corresponding to the sum of the thickness e of the connection piece and the thickness of the strip that remains beneath said connection piece) is substantially equal to the thickness E' such that the strip material is upset into the holes of the connection piece so as to form fixing studs 15.

Because of the presence of the indentations 19, 19', or 29 in the press tool, the fixing studs 15 even project a little from the face of the connection piece that is in contact with said tool, as shown in FIG. 4. Depending on the disposition of the connection piece and on the heights of these projecting portions, they can either be allowed to remain or, on the contrary, a final step can be performed of eliminating excess upset material.

Figure 6:
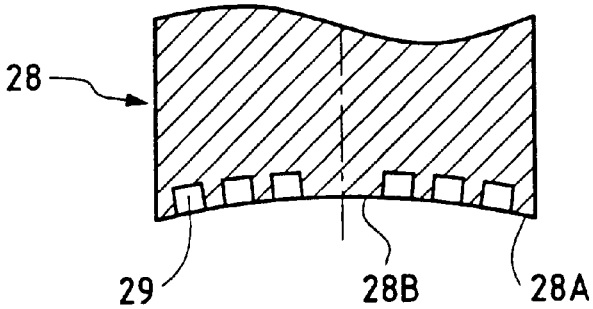
FIG. 6 is a section view of a press tool for making the ring of FIG. 5.

In the variant of FIGS. 6 and 7, the active face 28A of the press tool is concave, with the connection piece 12 being placed on the outside of the ring, as can be seen in FIG. 7. This variant has the advantage of ensuring that any stud material projecting beyond the outer face of the connection piece does not injure the object that is to be clamped.

Figure 5:
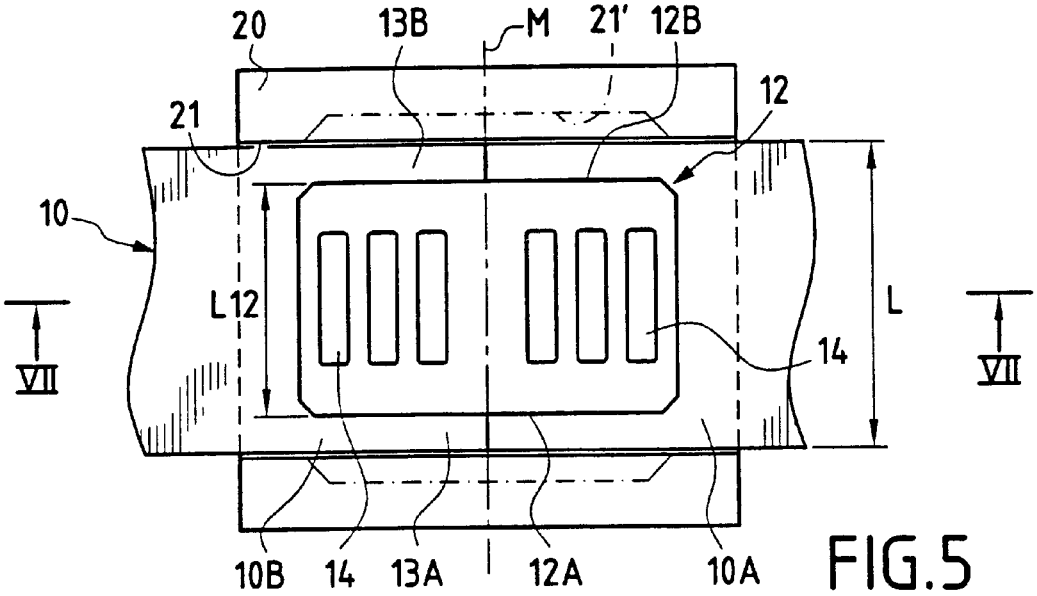
FIG. 5 is a plan view of the ring showing the connection zone between the ends of the strip.

FIG. 5 is a plan view of the region of the ring which includes the connection piece 12. This figure corresponds to a view seen along arrow F in FIG. 4 or along arrow G in FIG. 7.

In FIG. 5, it can be seen that the width L12 of the piece 12 is less than the width L of the strip 10. These two widths are measured in the axial direction of the swaging ring. The connection piece is disposed in such a manner as to allow longitudinal margins 13A and 13B of the strip to remain on either side of the longitudinal edges 12A and 12B of the connection piece. The longitudinal direction is lengthwise relative to the strip 10. Each of these margins 13A and 13B comprises a portion in each of the two ends 10A and 10B of the strip.

In the ring of FIG. 5, the connection piece is thus embedded not only in the thickness of the strip, but also within its width. This feature presents the advantage of further reinforcing the connection between the two ends of the strip since the connection piece is not accessible from either of the longitudinal edges of the strip.

It also has the advantage of avoiding the edges of the connection piece being subjected to corrosion.

In FIG. 5, the region of the ring which includes the connection piece is still placed on the backing tool of the press 20. It is set in the backing tool which is provided for this purpose with an indentation provided with setting edges 21. One possible shape for the setback 21' between the press tool and the backing tool during the pressing step is shown in chain-dotted lines, this setback 21' being filled during the pressing step with excess material due to the material of the strip being upset.

The pressing step can be followed by a step in which excess material is removed. In general, the shapes of the press tool and of the press backing tool are designed in such a manner as to control the upsetting of the strip material so that it takes place in certain zones. Naturally, this upsetting preferably takes place through the holes in the connection piece so as to create the fixing studs 15. As mentioned above, it is possible to allow upsetting to take place sideways into the zones 21'. The upset material can also fill any clearance that may exist between the end edges 11A and 11B of the strip where these two edges are placed facing each other.

Naturally, the pressing step is performed in such a manner that the strip material is flattened and upset in preference to the material of the connection piece 12. The person skilled in the art will consequently adjust the various parameters (travel speed, maximum pressure, preferred upsetting zone) of the pressing step accordingly.

Most advantageously, a connection piece is selected whose mechanical strength is greater than the mechanical strength of the strip. For example, the connection piece can be made out of aluminum-coated steel, the steel being work-hardened so as to present mechanical strength of the order of 600 $N/mm^2$ to 1000 $N/mm^2$, e.g. about 930 $N/mm^2$, while the strip can be made out of aluminum having mechanical strength of about 300 $N/mm^2$. The connection piece and the strip could also be made out of the same basic material, with work-hardening or heat treatment being applied to them after they have been cut out from a sheet so as to confer greater strength to the connection piece than to the strip.

The person skilled in the art will also select the number and size of the holes so as to obtain material upsetting that provides the desired studs.

Figure 8:
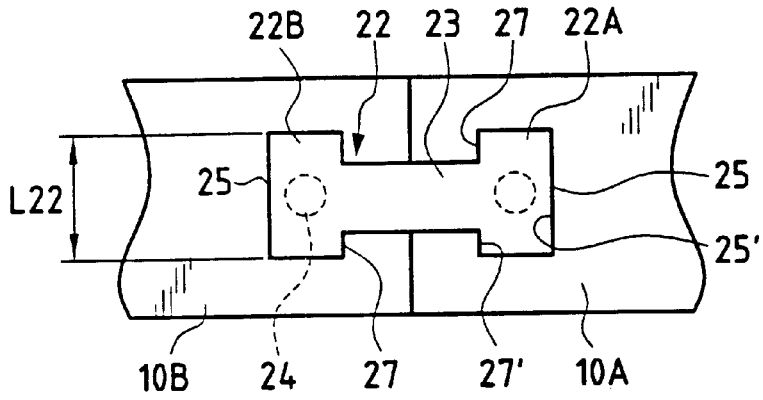
FIGS. 8 and 9 are fragmentary views of rings made in a first implementation, with different shapes of connection piece.

In FIG. 8, the ends 10A and 10B of the strip are united by a connection piece 22 whose outline forms the anchor edges. The ends 22A and 22B of the connection piece form broad heads of width L22 while the intermediate segment 23 is narrower. The end edges 25 of the heads 22A and 22B thus form anchor edges for connecting together the ends 10A and 10B against compression forces while the inner edges 27 (adjacent to the segment 23) of the heads 22A and 22B provide connection against traction forces pulling the ends 10A and 10B apart. These anchor edges co-operate with fixing members 25' and 27' of the strip that are upset against said anchor edges when the connection piece is put into place.

In addition to the anchor edges 25 and 27 formed in its perimeter, the connection piece 22 may optionally also have holes 24 shown in dashed lines so that their edges form additional anchor edges.

Figure 9:
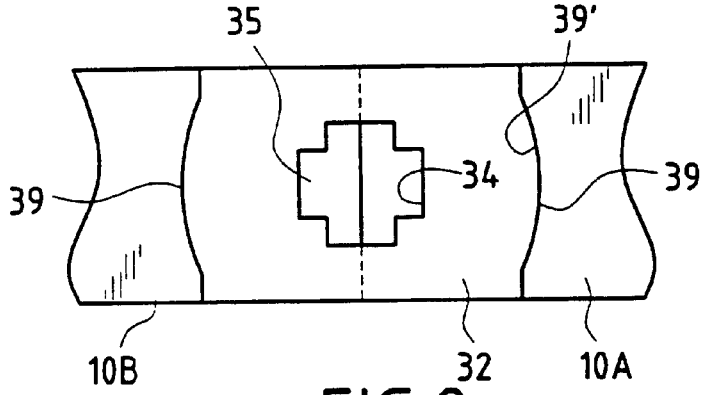

FIG. 9 shows a connection piece 32 having a central hole 34 disposed astride the ends 10A and 10B of the strip. Strip material upset while the connection piece is being put into place under pressure thus forms a fixing stud 35 having portions belonging to each of the two ends 10A and 10B. The edges of the hole 34 which extend transversely to the length of the strip form anchor edges that withstand traction forces, while the transverse ends 39 of the connection piece withstand compression forces in co-operation with the fixing members 39' upset against said edges while the connection piece is being put into place.

Figure 10:
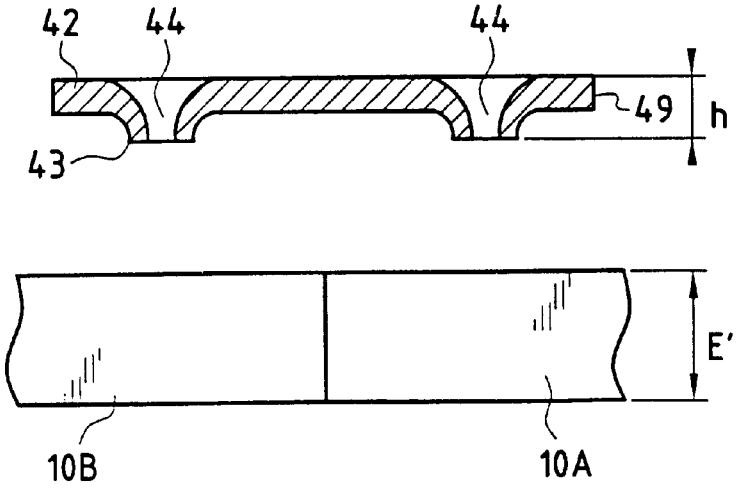
FIG. 10 is a side view of the ends of the strip before they have been connected together by means of a connection piece as shown in longitudinal section.

In FIG. 10, the connection piece 42 has holes 44 whose edges 43 project from the bottom face of the connection piece. When the connection piece is pressed against the ends 10A and 10B of the strip, these edges 43 become anchored in the thickness of the strip. To obtain fixing studs in the holes 44 that are formed by upsetting the material of the strip and that participate in holding the connection together, it is advantageous to ensure that the total height h of the edges 43 as measured from the face of the connection piece which is distant therefrom is less than the ordinary thickness E' of the strip. If the height h is equal to the thickness E', then the connection will be held by the edges 43 anchoring in the strip and by the end edges 49 of the connection piece, and any material upset into the holes 44 can optionally be removed thereafter.

The variants of FIGS. 8 to 10 are given as non-limiting examples. Other variants can be devised such as having indentations, grooves, or the like on the bottom face of the connection piece. To control the upsetting of the material and to expel the air which is pushed out ahead of said material, the grooves or the like can communicate with ambient air via the edges of the connection piece or via holes formed therein.

In the implementation of the method described with reference to FIGS. 3A, 3B, and 5, the connection piece is put into place against both ends of the strip prior to performing the pressing step. In another variant, the connection piece is placed against the first end of the strip by placing at least a first anchor edge on the first end of said strip, exerting pressure on the connection piece so as to displace the material of said first end that lies beneath the connection piece while forming at least a first fixing member in said first end suitable for co-operating with the first anchor edge, the second end of the strip is placed against the connection piece by placing said second end in register with at least one second anchor edge of the connection piece, and said piece is pressed so as to displace the material of said second end while forming at least one second fixing member in said second end suitable for co-operating with the second anchor edge. This variant implementation can also be applied to the second implementation (cutting out) as described below.

With reference to FIGS. 11 to 14, there follows a description of a variant of the invention in which the connection element is shaped in the first end of the strip.

Figure 11:
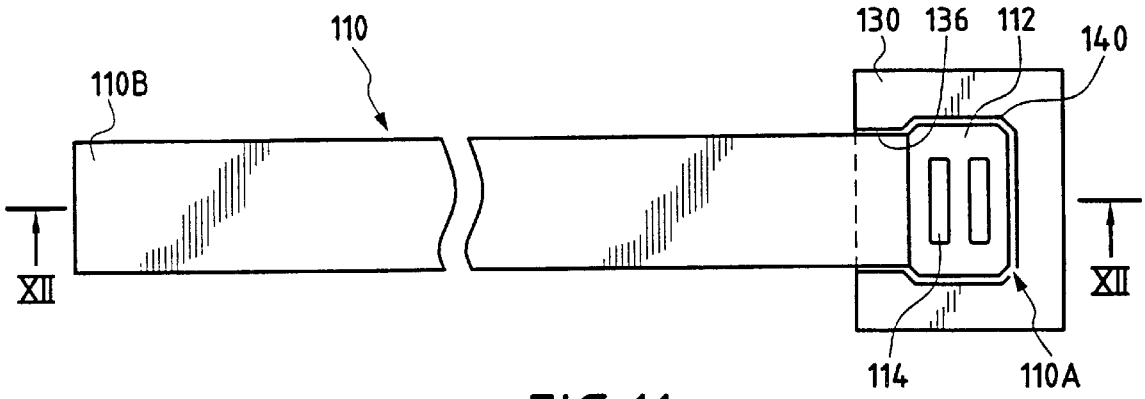
FIG. 11 is a plan view of a strip for making a swaging ring in a variant implementation, and shows its first end shaped into a connection element.

FIG. 11 is a plan view of the strip 110 from which the swaging ring of this variant is made. For example, it is a strip analogous to the strip 10, cut out from a sheet of material of the kind commonly used for making swaging rings This time, the connection element 112 is made directly in the first end 110A of the strip 110. This first end 110A is subjected to a shaping step in which at least one anchor edge is formed in said first end.

Figure 12:
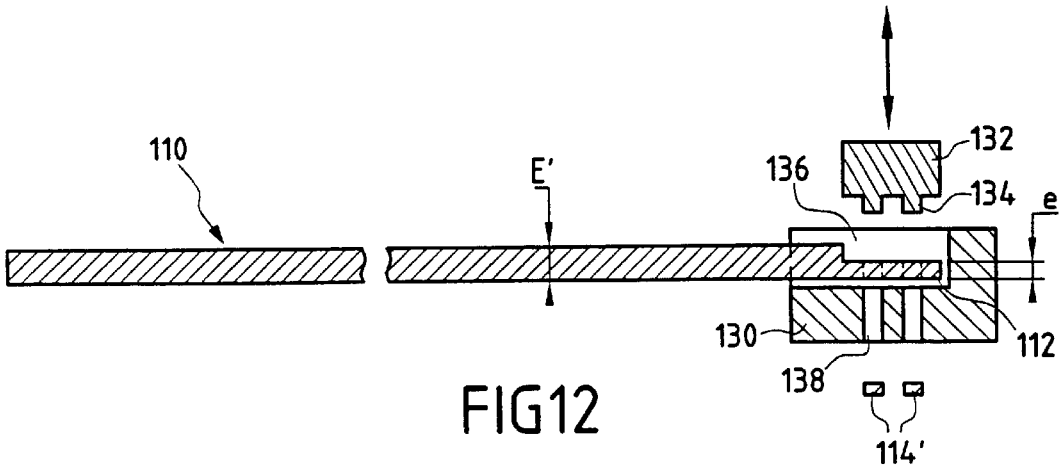
FIG. 12 is a section on line XII—XII of FIG. 11.
Figure 13:
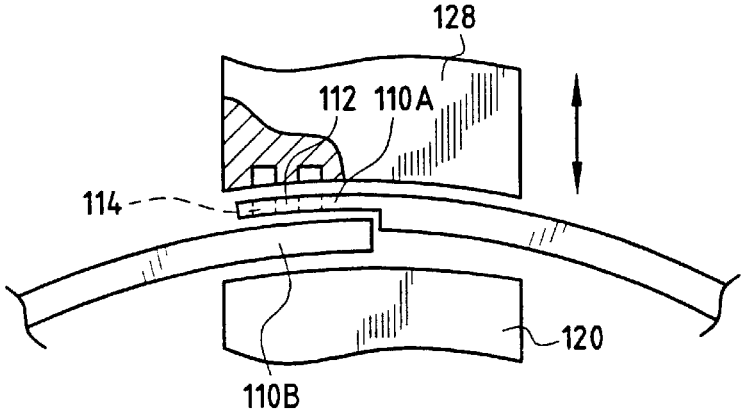
FIG. 13 shows how the two ends of this strip are connected together to form the swaging ring.

In FIGS. 11 to 13, a plurality of anchor edges are provided and are constituted by the edges of holes 114. For this purpose, it is possible to use a punch tool 132, for example, which is located in a punching station that also has a punch backing tool 130 on which the end 110A of the strip is placed, with the punch tool 132 being movable perpendicularly to the backing tool between a spaced-apart position where it is remote from the strip and an active, punching position. The punch tool has a number of punches 134 that matches the number of holes which are to be made.

For example, end 110A of the strip is placed in a housing in the form of an indentation 136 in the backing tool 130. This housing itself has cavities 138 enabling the punch to pass right through the strip and allowing punch waste 114' to be removed.

Advantageously, the connection element 112 has a thickness e which is less than the ordinary thickness E' of the strip 110. It is thus possible to use the punch tool 132 also as a press tool which serves to reduce the thickness of the end 110A during the punching operation. A setback 140 is then provided between the backing tool of the punch and the punch tool so as to allow excess material to be upset. For example, the setback 140 is made using a housing 136 of appropriate shape.

As shown in FIG. 13, to interconnect the two ends 110A and 110B of the strip, the end 110A having holes and constituting the connection element 112 is superposed on the other end 110B of the strip and the pressing step is performed by means of a press tool 128. The end 110B of the strip is held in place in the backing tool 120 and the press tool 128 is moved towards the backing tool in such a manner as to apply pressure on the end 110A of the strip, thereby causing material of the end 110B of the strip to be upset through the holes 114 so as to form fixing studs. During the pressing step, the excess material of the end 110B can also be upset. This excess upset material can fill any clearance that may exist and it can be removed subsequently.

During the pressing step, it is the material of the end 110B which is flattened and upset in preference to that of the end 110A. To make this happen, action can be taken on the travel and shape parameters of the press tool and of its backing tool. Preferably, steps are taken to ensure that the end 110A has greater mechanical strength than the end 110B of the strip. For this purpose, the method of making the swaging ring advantageously includes a step in which the strip 110 is subjected to treatment conferring greater mechanical strength to its first end 110A than to its second end. This treatment can apply to a region of the strip including the end 110B whose mechanical strength is to be reduced relative to the initial mechanical strength, or on the contrary it can apply to a portion of the strip which includes its end 110A so as to increase its mechanical strength. It is possible to use heat treatment or work-hardening, for example. The treatment can be performed practically simultaneously with the step of shaping the end 110A into a connection element 112, or immediately after said step.

FIG. 13 shows that the strip 110 has been rolled so as to present given curvature in the region of its superposed ends 110A and 110B. The press tool 128 has an active face whose curvature matches that of said given curvature.

The method advantageously includes a final step of rolling the swaging ring and of eliminating surplus material due to the upsetting, firstly from the end 110A, and subsequently from the end 110B.

Figure 14:
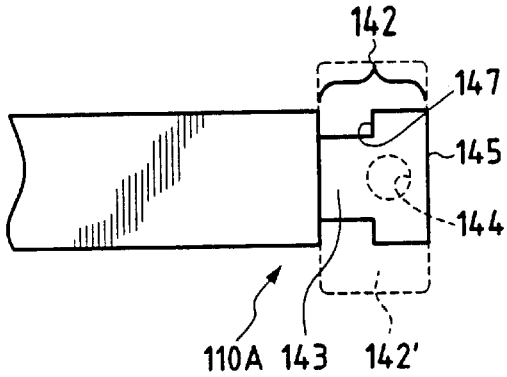
FIG. 14 shows a variant of the connection element of FIG. 11.
Figure 15:
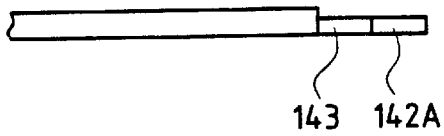
FIG. 15 is a side view of FIG. 14.

FIGS. 14 and 15 show a variant shape for the end 110A of the strip which carries the connection element 142. This element is made by flattening the end 110A so as to reduce its thickness (to substantially half the ordinary thickness of the strip), and by eliminating (cutting off) the waste represented by dashed lines and given the reference 142'. This "punching" (flattening+cutting) can be performed in one or two passes.

In the example shown, this cutting gives the element 142 substantially a T-shape, with a free end formed by a broad head 142A that is connected to the strip by a thinner trunk 143, the width of the head being equal to or less than the ordinary width of the strip.

This T-shape is an embodiment in which the anchor edges of the connection element which is formed at one end of the strip are shaped in the outline or in the surface of said connection element. As in the example of FIG. 8, one anchor edge 145 is formed at the free end of the head 142A, and two anchor edges 147 are formed on the "inner" edge of said head.

Such a connection element may also present one or more holes, such as the hole 144 shown in dashed lines.

Figure 16:
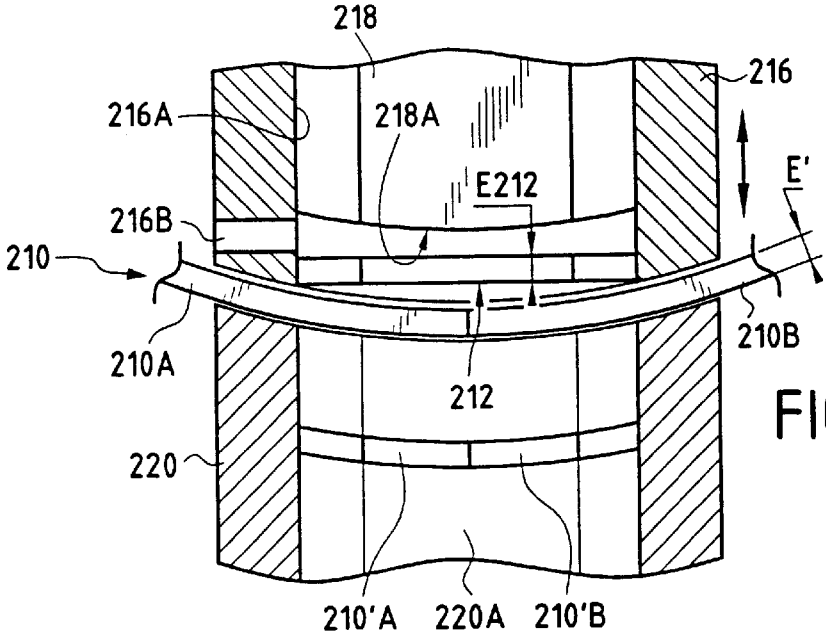
FIG. 16 is a view analogous to FIG. 3A for the second implementation of the invention, in which the ends of the strip are connected together by cutting out using a connection piece.
Figure 17:
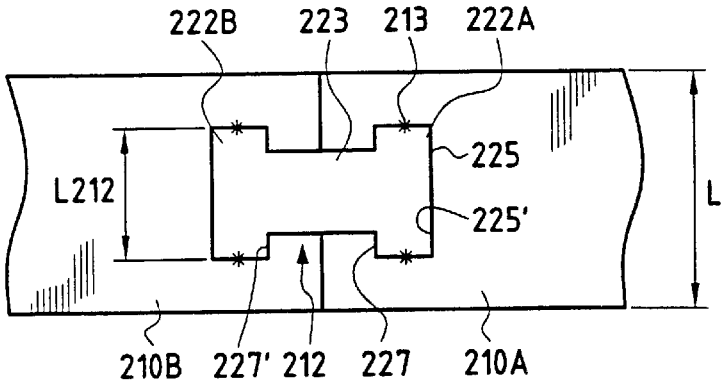
FIG. 17 is a fragmentary view in the region of the ends of the strip after they have been connected together by means of the connection piece of FIG. 16.

With reference to FIGS. 16 and 17, there follows a description of an implementation in which the connection element unites the ends of the strip by filling a cutout formed by said connection element.

In FIG. 16, the ends 210A and 210B of the strip 210 are placed tip to tip in a cutting and joining station. The connection element is constituted by a piece 212 and it is placed against said end while being held in a sleeve 216A of suitable shape formed in a blank press 216. As in above-described FIGS. 3A and 3B, other holding means could be envisaged (claws, . . . ). The ends of the strip are held between the blank press 216 and a backing tool for cutting 220 which has a cavity 220A of overall shape matching that of the piece 212 and enabling cutting waste to be removed. The waste from the previous cut is thus referenced 210'A and 210'B.

The press tool 218 has an active face 218A of a shape that matches the shape of the connection piece. It is movable back and forth in the sleeve 216A between an inactive position as shown in FIG. 16 (in which the means 216B for putting the connection piece into place are disengaged) and an active or pressing position. The blank press 216 and/or the backing tool 220 are movable so as to allow the ends of the strip to be inserted and so as to enable them to be held securely in position. The stroke of the tool 218 is adjusted in such a manner as to enable the ends of the strip to be cut while simultaneously placing the connection piece 212 so that it occupies the place previously occupied by the cutting waste which is removed.

The connection between the connection piece and the strip is thus provided without clearance. Optionally, in order to hold the connection piece more securely in the plane of the ends of the strip, it is possible after said connection piece has been put into place, to stamp a few non-through points on the interface edges between the connection piece and the strip, as indicated by reference 213 in FIG. 17.

In this figure, the appearance of the connection piece can be seen more clearly, which piece is generally analogous to the piece shown in FIG. 8, having broad heads 222A and 222B and an intermediate segment 223, except that its thickness E212 is equal to the ordinary thickness E' of the strip. The width L212 of the broad heads is less than the ordinary width L of the strip. The anchor edges 225 and 227 formed respectively in the free ends and in the "inner" edges of the heads 222A and 222B co-operate with fixing members 225' and 227' constituted by the cutout edges adjacent to said anchor edges.

What is claimed is:

1. A method of manufacturing a swaging ring, wherein a metal strip having an ordinary thickness and presenting two ends is rolled into a hoop and wherein said ends are ends connected together by a connection element having a thickness at the most substantially equal to said ordinary thickness and presenting at least one anchor edge, and wherein, to connect said connection element to one end of the strip having a thickness substantially equal to said ordinary thickness, the connection element is placed against said end in such a manner that said anchor edge of the connection element is in register with said end, and pressure is exerted on the connection element in such a manner as to upset the material of said end of the strip lying beneath the connection element while providing a fixing member in said end suitable for co-operating with said anchor edge to hold the connection element and said end of the strip relative to each other in such a manner that a thickness of the ring in the region of the connection element is substantially equal to said ordinary thickness of the strip.

2. A method according to claim 1, wherein a connection element is provided whose maximum width is less than a width of the strip, and wherein said connection piece is placed in such a manner as to leave longitudinal margins of the strip along longitudinal edges of said piece.

3. A method according to claim 1, wherein a connection element is used of thickness that is less than the ordinary thickness of the strip, wherein the connection element is placed against one end of the strip, and wherein pressure is exerted on said connection element in such a manner as to flatten said end of the strip until a thickness of the ring in the vicinity of the connection element is substantially equal to said ordinary thickness of the strip and in such a manner as to cause the material of said end to be upset so as to form at least one retaining element against the anchor edge of the connection element.

4. A method according to claim 3, wherein a connection element is used having at least one hole whose edge forms an anchor edge, and wherein the pressure exerted on the connection element causes material of the metal strip to be upset so as to form a fixing stud in said hole.

5. A method according to claim 1, wherein pressure is exerted on the connection element in such a manner as to cut the material upset by said connection element away from the strip until the connection element takes the place of the upset and cutaway material, and the upset and cut-away material is removed.

6. A method according to claim 1, wherein the connection element is formed in a first end of the strip during a shaping step, and wherein in order to connect together the two ends of the strip, the shaped first end is superposed on the second end of the strip and said pressure is exerted.

7. A method according to claim 6, wherein the strip is subjected to treatment imparting mechanical strength to the first end of said strip that is greater than a mechanical strength of the second end of the strip.

8. A swaging ring comprising a metal strip that is rolled into a hoop, said strip having ends which are connected together by a connection element having at least one anchor edge, said connection element being connected to one end of the strip by at least one fixing member formed against the anchor edge by putting said connection element into place, the connection between the strip and the connection element having no clearance, and a thickness of the ring in the vicinity of the connection element being substantially equal to an ordinary thickness of the strip.

9. A swaging ring according to claim 8, wherein the connection element is constituted by a connection piece that is distinct from the strip and that includes at least one hole placed astride the two ends of the strip.

10. A swaging ring according to claim 8, wherein the connection element is constituted by a connection piece that is distinct from the strip and that includes at least two holes in which two fixing studs belonging to each of the two ends of the strip respectively are formed by upsetting.

11. A swaging ring according to claim 8, wherein the connection element is constituted by a connection piece having anchor edges formed in a surface thereof.

12. A swaging ring according to claim 8, wherein the connection piece is of a thickness substantially equal to the ordinary thickness of the strip.

13. A swaging ring according to claim 8, wherein the connection element is constituted by a connection piece that is distinct from the strip and wherein the connection piece has an average thickness substantially equal to half the ordinary thickness of the strip.

14. A swaging ring according to claim 8, wherein the connection element is constituted by a connection piece that is distinct from the strip, wherein the connection piece is of a width smaller than a width of the strip, and wherein longitudinal margins of the strip are provided along longitudinal edges of the connection piece.

15. A swaging ring according to claim 8, wherein the connection element is constituted by a first end of the strip having at least one anchor edge, the first and second ends of the strip being flattened against each other, and a fixing member belonging to the second end being formed against said anchor edge.

16. A swaging ring according to claim 8, wherein the connection element has a mechanical strength greater than a mechanical strength of the end(s) of the strip with which it co-operates.

17. An installation for manufacturing a swaging ring comprising: means for rolling up a metal strip into a hoop; and means for connecting together ends of said strip by a connection element having at least one anchor edge, the installation comprising means for placing the connection element against one end of the strip so that at least one anchor edge of said connection element is in register with said end, and a press tool for exerting pressure on the connection element in such a manner as to upset the material of said end of the strip that lies beneath the connection element while providing in said end a fixing member suitable for co-operating with said anchor edge in order to hold together the connection element and said end of the strip in such a manner that a thickness of the ring in the vicinity of the connection element is substantially equal to a thickness of the strip.

18. An installation according to claim 17, wherein the press tool has an active pressure face of a shape that is analogous to a shape of a zone of the connection element with which said active face is to co-operate.

19. An installation according to claim 17, wherein the connection element has at least one hole, and wherein the active pressure face has at least one indentation suitable for being put in register with said at least one hole of the connection element and at least one solid portion suitable for being placed in register with a solid zone of the connection element.

20. An installation according to claim 17, wherein the means for rolling the metal strip into a hoop are suitable for shaping the strip by imparting given curvature thereon in the region of the ends thereof prior to placing the connection element against one end of the strip, and wherein the press tool has an active face of curvature substantially equal to said given curvature.

21. An installation according to claim 17, including means for shaping a first end of the strip into a connection element, said means comprising a punch tool suitable for forming at least one anchor edge in said first end.

22. A method of manufacturing a swaging ring, wherein a metal strip having an ordinary thickness and presenting two ends is rolled into a hoop, wherein said ends are ends connected together by a connection piece that is separate from the strip, that has at least two anchor edges and that has a thickness at the most substantially equal to said ordinary thickness and wherein, to connect said connection element to said end of the strip having each a thickness substantially equal to said ordinary thickness, the connection element is placed against said ends in such a manner that an anchor edge of the connection element is in register with each of said ends, and pressure is exerted on the connection element in such a manner as to upset the material of said ends of the strip lying beneath the connection element while providing at least one fixing member in each of said ends suitable for co-operating with each of said anchor edges so as to connect the connection piece respectively to the first and second ends of the strip in such a manner that a thickness of the ring in the region of the connection piece is substantially equal to a thickness of the strip.

23. A method according to claim 22, wherein a connection piece is provided whose maximum width is less than a width of the strip, and wherein said connection piece is placed in such a manner as to leave longitudinal margins of the strip along longitudinal edges of said piece.

24. A method according to claim 22, wherein the strip has end edges which are placed facing each other, wherein the connection piece is placed against the strip by placing at least a first anchor edge on the first end of the strip and at least a second anchor edge on the second end of the strip, and wherein pressure is exerted in such a manner as to upset the material of the two ends of the strip beneath the connection piece while forming fixing members in each of said two ends, said fixing members being suitable for co-operating respectively with said first and second anchor edges.

25. A method according to claim 22, wherein the connection piece is placed against the first end of the strip by placing at least a first anchor edge on the first end of said strip, wherein pressure is exerted on the connection piece in such a manner as to upset the material of said first end which underlies the connection piece while forming at least one first fixing member in said first end suitable for co-operating with the first anchor edge, wherein the second end of the strip is placed against the connection piece by placing said second end in register with at least one second anchor edge of the connection piece, and pressure is exerted on said piece in such a manner as to upset the material of said second end while forming at least one second fixing member in said second end suitable for co-operating with the second anchor edge.

26. A method according to claim 22, wherein a connection piece is used of thickness that is less than the ordinary thickness of the strip, wherein the connection piece is placed against the ends of the strip, and wherein pressure is exerted on said connection piece in such a manner as to flatten said ends of the strip until a thickness of the ring in the vicinity of the connection piece is substantially equal to said ordinary thickness of the strip and in such a manner as to cause the material of said ends to be upset so as to form at least one retaining element against each anchor edge of the connection piece.

27. A method according to claim 26, wherein a connection piece is used having at least one hole whose edge forms an anchor edge, and wherein the pressure exerted on the connection piece causes material of the metal strip to be upset so as to form a fixing stud in said hole.

28. A method according to claim 27, wherein the connection piece has at least two holes, and wherein the piece is put into position and pressure is exerted thereon in such a manner as to cause material of the first end of the strip to be upset, thereby causing a first fixing stud belonging to said first end to be formed in a first hole of the connection piece, and causing the material of the second end of the strip to be upset so as to form a second fixing stud belonging to said second end in a second hole of the connection piece.

29. A method according to claim 22, wherein pressure is exerted on the connection piece in such a manner as to cut the material upset by said connection piece away from the strip until the connection piece takes the place of the upset and cutaway material, and the upset and cut-away material is removed.

30. A method according to claim 29, wherein the connection piece has an outline defining anchor and cutting edges.

* * * * *